US011779127B2

(12) United States Patent
Van Doornewaard et al.

(10) Patent No.: US 11,779,127 B2
(45) Date of Patent: Oct. 10, 2023

(54) AIR HANDLING UNIT FOR ENVIRONMENTALLY CONDITIONED FURNITURE, AND ASSOCIATED SYSTEMS AND METHODS

(71) Applicant: Pure-Development 1 B.V., Baarn (NL)

(72) Inventors: Barry Van Doornewaard, Baarn (NL); Michiel Maria Augustinus Steegmans, Baarn (NL)

(73) Assignee: Pure-Development 1 B.V.

( * ) Notice: Subject to any disclaimer, the term of this patent is extended or adjusted under 35 U.S.C. 154(b) by 103 days.

(21) Appl. No.: 17/198,108

(22) Filed: Mar. 10, 2021

(65) Prior Publication Data

US 2022/0287471 A1 Sep. 15, 2022

(51) Int. Cl.
*A47C 21/04* (2006.01)

(52) U.S. Cl.
CPC ..... *A47C 21/044* (2013.01)

(58) Field of Classification Search
CPC ..... A47C 21/04; A47C 21/042; A47C 21/044; A47C 21/046; A47C 21/048; A47C 21/06
See application file for complete search history.

(56) References Cited

U.S. PATENT DOCUMENTS 3,164,110 A 1/1965 Bofinger
3,266,064 A 8/1966 Figman
3,513,490 A 5/1970 Wagner
3,736,604 A * 6/1973 Carson, Jr. ..... A47C 31/001 5/678
3,746,835 A 7/1973 Yu et al.
4,186,452 A 2/1980 Underwood
4,939,804 A * 7/1990 Grant ..... A47C 21/044 5/423
5,408,711 A 4/1995 McClelland
5,678,352 A 10/1997 Leitner et al.
5,887,304 A 3/1999 Von
6,584,627 B1 7/2003 Yang
(Continued)

FOREIGN PATENT DOCUMENTS

CA 2482406 C 9/2003
CN 2191584 Y 3/1995
(Continued)

OTHER PUBLICATIONS

Freshbed, "FreshBed iFo 3D-Animation," (https://www.youtube.com/watch?v=j9J3elNZuu0), Nov. 18, 2020.
(Continued)

*Primary Examiner* — David R Hare
*Assistant Examiner* — George Sun
(74) *Attorney, Agent, or Firm* — Perkins Coie LLP

(57) ABSTRACT

An air distribution unit for environmentally controlled furniture, such as a bed. In representative embodiments, the air distribution unit includes a fan enclosure for accommodating a fan, with a fan enclosure inlet upstream of the fan and a fan enclosure outlet downstream of the fan, the fan enclosure including an air-flow guidance member positioned in the fan enclosure, which defines at least in part, an air-flow path between the fan enclosure inlet and the fan enclosure outlet, wherein an inner surface of the air-flow guidance member, adjacent to the air-flow path, is at least partially sound-absorbing.

27 Claims, 2 Drawing Sheets

(56) References Cited

U.S. PATENT DOCUMENTS

| | | | | |
|---|---|---|---|---|
| 7,178,183 | B2 | 2/2007 | Cho | |
| 7,837,932 | B2 | 11/2010 | Hedman | |
| 8,272,143 | B1 | 9/2012 | Hedman | |
| 9,131,675 | B2 | 9/2015 | Smith | |
| 9,756,952 | B2 | 9/2017 | Alletto, Jr. et al. | |
| D819,357 | S | 6/2018 | van Doornewaard | |
| 10,034,550 | B2 | 7/2018 | Rydsund | |
| 2003/0019044 | A1* | 1/2003 | Larsson | A47C 31/007 5/724 |
| 2003/0070235 | A1* | 4/2003 | Suzuki | F24H 3/0405 5/482 |
| 2003/0145380 | A1 | 8/2003 | Schmid | |
| 2004/0253920 | A1* | 12/2004 | Schoettle | A47C 21/044 454/907 |
| 2005/0229319 | A1* | 10/2005 | Cho | A47C 27/12 5/948 |
| 2006/0053558 | A1* | 3/2006 | Ye | A47C 27/18 5/689 |
| 2006/0101577 | A1* | 5/2006 | Lussier | A47C 21/048 5/423 |
| 2007/0136952 | A1 | 6/2007 | Sargent | |
| 2008/0313810 | A1 | 12/2008 | Cretsinger et al. | |
| 2009/0064411 | A1 | 3/2009 | Marquette et al. | |
| 2010/0005588 | A1 | 1/2010 | Christopher | |
| 2010/0011502 | A1 | 1/2010 | Brykalski et al. | |
| 2010/0115696 | A1 | 5/2010 | Felix, Jr. et al. | |
| 2010/0319125 | A1* | 12/2010 | Ko | A47C 21/048 5/423 |
| 2011/0296610 | A1 | 12/2011 | Moon et al. | |
| 2012/0186138 | A1 | 7/2012 | Bell et al. | |
| 2012/0233907 | A1 | 9/2012 | Pattison et al. | |
| 2012/0240451 | A1 | 9/2012 | Ricks | |
| 2012/0285944 | A1 | 11/2012 | Bermudez | |
| 2013/0061395 | A1 | 3/2013 | Karl et al. | |
| 2013/0263496 | A1 | 10/2013 | Maloney et al. | |
| 2013/0276358 | A1 | 10/2013 | Knote et al. | |
| 2014/0109314 | A1 | 4/2014 | Boersma et al. | |
| 2014/0137569 | A1* | 5/2014 | Parish | F24F 5/0042 62/3.2 |
| 2014/0173970 | A1 | 6/2014 | Martin | |
| 2014/0201909 | A1* | 7/2014 | Weyl | A61G 7/05746 5/423 |
| 2014/0271349 | A1* | 9/2014 | Gowda | A61L 9/20 422/4 |
| 2015/0208814 | A1 | 7/2015 | Alletto, Jr. et al. | |
| 2016/0136385 | A1 | 5/2016 | Scorcioni | |
| 2017/0202365 | A1 | 7/2017 | Polevoy et al. | |
| 2017/0296412 | A1 | 10/2017 | Hung | |
| 2017/0348182 | A1* | 12/2017 | Yoo | A47C 31/008 |
| 2018/0110341 | A1* | 4/2018 | Reynolds | A47C 21/044 |
| 2018/0160819 | A1* | 6/2018 | Rutledge | A47C 21/003 |
| 2018/0271300 | A1* | 9/2018 | Wang | A61G 7/05784 |
| 2019/0105458 | A1* | 4/2019 | Hammes | A61L 9/122 |
| 2019/0126000 | A1* | 5/2019 | Main | F24F 5/00 |
| 2019/0320808 | A1 | 10/2019 | Chapin et al. | |
| 2019/0380501 | A1 | 12/2019 | Reynolds | |
| 2020/0170418 | A1* | 6/2020 | Oh | A47C 21/048 |
| 2020/0198509 | A1 | 6/2020 | Conze et al. | |
| 2020/0237106 | A1 | 7/2020 | Alletto, Jr. et al. | |
| 2020/0397148 | A1* | 12/2020 | Elliott | A47C 21/048 |
| 2021/0204709 | A1* | 7/2021 | Grabinger | A47C 31/007 |
| 2021/0204720 | A1 | 7/2021 | Karschnik et al. | |
| 2021/0227987 | A1 | 7/2021 | Alletto, Jr. et al. | |
| 2021/0307524 | A1* | 10/2021 | Nishida | A47C 21/044 |
| 2021/0307525 | A1* | 10/2021 | Kim | A47C 27/064 |
| 2021/0307529 | A1* | 10/2021 | Kim | A47C 21/044 |
| 2021/0307531 | A1* | 10/2021 | Lee | A47C 23/002 |

FOREIGN PATENT DOCUMENTS

| | | | |
|---|---|---|---|
| CN | 204105404 | U | 1/2015 |
| DE | 20113292 | U1 | 9/2002 |
| DE | 102017003332 | A1 | 10/2018 |
| EP | 0957727 | B1 | 3/2002 |
| EP | 1804616 | B1 | 2/2012 |
| GB | 379439 | A | 9/1932 |
| GB | 2334889 | A | 9/1999 |
| JP | S5670719 | A | 6/1981 |
| JP | H04108411 | A | 4/1992 |
| JP | H04108498 | A | 4/1992 |
| JP | H09140506 | A | 6/1997 |
| KR | 20140071931 | A | 6/2014 |
| KR | 20180053024 | A | 5/2018 |
| KR | 20200092139 | A | 8/2020 |
| KR | 20200002751 | U | 12/2020 |
| WO | 1996039905 | A1 | 12/1996 |
| WO | 2005120295 | A1 | 12/2005 |
| WO | 2013017869 | A1 | 2/2013 |

OTHER PUBLICATIONS

Partial search report issued for corresponding NL Application No. 2027735, Applicant: Pure-Development 1 B.V., dated Dec. 9, 2021, 14 pages.

International Search Report and Written Opinion dated Aug. 22, 2022 in International Application No. PCT/NL2022/050131, 16 pages.

* cited by examiner

AIR HANDLING UNIT FOR ENVIRONMENTALLY CONDITIONED FURNITURE, AND ASSOCIATED SYSTEMS AND METHODS

TECHNICAL FIELD

The present technology is directed generally to environmentally controlled or conditioned furniture, such as beds and seats, and in particular, to air handling units used in such furniture.

BACKGROUND

EP1804616A1 discloses environmentally conditioned furniture, such as a bed, with a permeable mattress or cushion set upon a plenum chamber base. The bed further includes a ventilator fan, a distribution duct and a heater, which work together to take in ambient air and expel conditioned chamber air through the mattress, wherein the conditioned air has a controlled temperature and/or relative humidity for the comfort and/or respiratory benefit of a bed occupant.

SUMMARY

Environmentally conditioned furniture allows close control of the skin temperature of a person, for example in a bed or another piece of furniture arranged for accommodating a sleeping person. Skin temperature and variation of skin temperature are important factors in improving sleep quality. It has been observed that environmentally conditioned furniture may generate undesired noise, compared to conventional furniture. It is therefore desirable to reduce the generated noise.

A first aspect of the present technology includes an air distribution unit for environmentally controlled furniture, such as a bed. The air distribution unit includes a fan enclosure for accommodating a fan. The fan may be motor-driven and used to generate a controlled airflow. The fan enclosure has an inlet oriented upstream of the fan and a fan enclosure outlet oriented downstream of the fan so that the airflow generated by the motor-driven fan draws air into the fan enclosure from the inlet and pushes the drawn-in air through the outlet. The fan enclosure further includes an air-flow guidance member, at least partially positioned in the fan enclosure, which helps guide the airflow from the inlet to the outlet during operation. An air-flow inner surface of the air-flow guidance member, adjacent to which the air-flow moves, is at least partially sound-absorbing. Conditioning may include one or more of providing air to the upholstery or withdrawing air therefrom, heating, cooling, filtering, humidifying, dehumidifying, sterilising, scenting, de-scenting, other, or a combination thereof.

The use of sound-absorbing technology within the fan enclosure, such as on the inner surface of the airflow guidance member, may help mitigate sound energy generated within the fan enclosure from escaping and reaching the nearby user's ear, as noise. In other words, the present fan enclosure may be quiet during use, or at least sufficiently quiet to prevent or reduce negative impact on the user's sleep.

A sound absorbing material may be understood to be any material or combination of materials which are arranged to absorb at least a portion of the sound energy of a sound wave encountering the material, as opposed to a non-sound absorbing material which would reflect all or a majority of any impacting sound energy. As is generally understood by those skilled in the art, such sound-absorbing materials typically convert sound energy into thermal energy, or mechanical movement, thereby effectively removing some or all of the sound energy. Sound absorbing materials are typically soft, pliable, and/or porous, such as foams, in particular, open-cell foams, cork, wood, and/or cloth. Depending on the type of material used, the thickness of the material, and the texture of the material surface, sound absorbing material may absorb different amounts of the sound energy of an impinging sound wave, usually between 10% and 90%.

The fan enclosure may further have a top guidance member positioned adjacent to the air-flow guidance member, wherein at least part of the top guidance member is sound-absorbing and adjacent to the air-flow path.

As a further option, the fan enclosure may have a bottom guidance member positioned adjacent to the air-flow guidance member and the fan enclosure, wherein at least part of the bottom guidance member is sound-absorbing and adjacent to the air-flow path.

In particular, the air-flow guidance member or at least a part thereof may be sandwiched between the top guidance member and the bottom guidance member. As such, the air-flow path may be constrained by the air-flow guidance member, the top guidance member, and the bottom guidance member. Using separate guidance members may ease construction and/or manufacturing of the air distribution unit, and in particular, the fan enclosure.

Any of the air-flow guidance member, the top guidance member, and/or the bottom guidance member may comprise or consist of sound-absorbing material, such as foam, in particular, open-cell foam.

The air distribution unit may include a heating unit for increasing the temperature of the airflow passing therethrough. The heating unit may include a plurality of channels oriented generally parallel to the air-flow path. Air-flow may thus flow freely through the channels, during which thermal energy may be exchanged between air in the air-flow and the heating unit accommodated in the fan enclosure.

An air distribution unit for environmentally controlled furniture, such as a bed, can include a fan enclosure for accommodating a fan, with a fan enclosure inlet upstream of the fan, and a fan enclosure outlet downstream of the fan. The overall system can further comprise a heating unit having a plurality of channels oriented generally parallel to an air-flow path between the fan enclosure inlet and the fan enclosure outlet. This particular embodiment of the air distribution unit may or may not comprise an air-flow guidance member. Any options disclosed in conjunction with other embodiments of air distribution units and/or heating units may be readily applied to this particular embodiment of the air distribution unit.

A heating unit may be arranged for converting electrical energy into thermal energy for an air-flow flowing past and/or through the heating unit. As a particular option, the heating unit may be or comprise a Positive Temperature Coefficient (PTC) heater. A PTC heater uses positive temperature coefficient materials which exhibit a positive resistance change in response to an increase in temperature. Using such materials, a self-regulating heating unit may be obtained which prevents overheating of the heating unit.

As a particular option, the heating unit may comprise a base, and the plurality of channels may be formed by a plurality of fins extending from the base, similar to the fins of a conventional heat-sink. As a further option, the length of the channels may exceed a width and/or height of the individual channels, e.g., by a factor of two or more, four or more, or eight or more. It will be appreciated that a channel may be fully enclosed (e.g., tubular) in a cross-sectional view, or may be partially open (e.g., a C-channel) in a cross-sectional view perpendicular to an air-flow direction through the channel.

At least one of the fins of one example of the heating unit may include an end flange at a distal end of the fin. The end flange protrudes from the fin at an angle relative to the fin. Owing to the addition of the at least one end flange to at least one fin, a larger surface area is created along which the air-flow contacts the fin. The larger area will allow for more effective transfer of heat energy from the fin structure to the passing air.

An air distribution unit may further comprise a UV treatment module comprising a radiation source for emitting UV-radiation with a wavelength of, for example, between 100-280 nm. The UV treatment module is positioned in fluid communication with the air-flow path so that the air-flow passes through the emitted UV radiation. The purpose of the UV treatment is to sterilize the air-flow.

An outer housing may be provided around at least part of the fan enclosure. Such an outer housing may provide protection and/or stiffness to the fan enclosure. In particular, when the fan enclosure includes sound-absorbing materials, the stiffness and/or strength of the fan enclosure may be relatively low, for example when the sound-absorbing material is a foam. The outer housing may comprise non-sound-absorbing materials such as metals and/or high density polymers for the purpose of providing strength to the fan enclosure.

The fan may be mounted within the fan enclosure, and/or may be mounted or connected to the outer housing. The heating unit may be mounted in the fan enclosure, and/or may be mounted or connected to the outer housing. One or more through holes may be provided through the outer housing, for example aligned with one or both of the fan enclosure inlet and the fan enclosure outlet.

A fan may, for example, be axial fan, a cross-flow fan, a squirrel cage fan, a centrifugal fan, or any other suitable type of mechanism for generating an airflow, such as a bellows. If a conventional fan is used, the fan structure may include any suitable number of blades at any suitable pitch-angle, depending on several parameters, as understood by those skilled in the art. Such parameters include desired airflow speed and volumetric rate (e.g., as measured in CFM (cubic feet per minute)), size and power of the driving motor, and/or the air-resistance of the entire flow system. The driving motor is electric and controllable by a control unit.

A second aspect of the present technology (e.g., a C-channel) provides environmentally controlled furniture, such as a bed, having a bed frame for supporting an air-permeable mattress or cushion. The bed frame includes an air inlet with an inlet flow-through area, an air outlet with an outlet flow-through area, which air outlet is in fluid communication with the air inlet and wherein the furniture further includes an air distribution unit, of which a fan enclosure inlet is in fluid communication with the air outlet and the fan enclosure outlet is in fluid communication with the air-permeable mattress or cushion. The furniture may comprise the air-permeable mattress or cushion.

Representative examples of suitable furniture include couches, chairs, convertible sofas, sleeper sofas, chaises lounges, an/or any other furniture comprising a mattress or cushion on which a person may sit and/or lie down.

Furniture, such as a bed, may, as an option, include a presence sensor module for detecting the presence of a person on the furniture and/or in a room in which the furniture is present. Furniture may further comprise a control unit for controlling the air distribution unit based on the presence sensor signal.

The sensor module may optionally comprise one or more sensors for detecting one or more physical parameters of one or more persons on the furniture and/or in a room in which the furniture is present and for generating one or more parameter signals indicative of the detected one or more physical parameters.

Examples of physical parameters are a body temperature, heart rate, breathing parameters such respiratory rate and/or respiratory pattern, and respiratory noise such as snoring. When the furniture is arranged for accommodating multiple persons, separate parameter signals may be generated per person.

Based on the one or more parameter signals, the control unit may control the air distribution unit.

The control unit may include a microprocessor and be programmed to perform a method for operating an air distribution unit of an environmentally controllable furniture.

A third aspect provides a method for operating an air distribution unit of an environmentally controllable piece of furniture, for example furniture according to the second aspect The method includes the process of detecting, by using a presence sensor module, a presence of a person on the furniture and/or in a room in which the furniture is present. Then, operating, in response to detecting the presence of a person, the air distribution unit in a first operating mode. And further, operating, in response to detecting no presence of people, the air distribution unit in a second operating mode.

The presence sensor module may for example be or comprise one or more cameras, pressure sensors, sound sensors, RADAR sensors, motion sensors, any other sensor(s) which can detect the presence of a person on the furniture and/or in a room in which the furniture is present.

When a person is present on the furniture and/or in a room in which the furniture is present, it may be desired to have a lower level of noise generated by the furniture, in particular by the air distribution unit, than during times when the room and/or furniture piece are empty.

The air distribution unit may utilize a fan for generating an air-flow with at least two air-flow speeds. A first low speed is used in a first operating mode, while a second higher speed is used in a second operating mode.

The sound generated by the system when the fan is operating in the higher-speed second operating mode will determine the highest noise level of the bed during operation. This will occur when people are not present in either the bed (or other furniture piece), or in the room.

In the second operating mode, when the motor and fan are operating at a higher speed, more air may flow through the furniture, and in particular through an air-permeable mattress or cushion of the furniture. With an increased air-flow, a desired temperature and/or humidity may be achieved more quickly in the air-permeable mattress or cushion, and/or in a room in which the furniture is positioned.

It will be appreciated that embodiments of the air distribution unit, furniture and method are envisioned comprising one or more or all of the disclosed options. Options disclosed in conjunction with one of the aspects may be readily applied to other aspects, were applicable.

BRIEF DESCRIPTION OF THE DRAWINGS

The present technology will further be elucidated on the basis of representative embodiments which are represented in the drawings. The representative embodiments are provided by way of non-limitative illustration. It is noted that the figures are only schematic representations of embodiments of the present technology that are given by way of non-limiting example.

In the figures.

DETAILED DESCRIPTION

By way of introduction, so-called ventilated or conditioned beds direct blown air from outside a bed, up through a mattress, and around the user of the bed. The present embodiments of this disclosure, as described in detail below, provide an air distribution unit that includes a motor, a fan, and a heater, among other components.

Figure 1A:
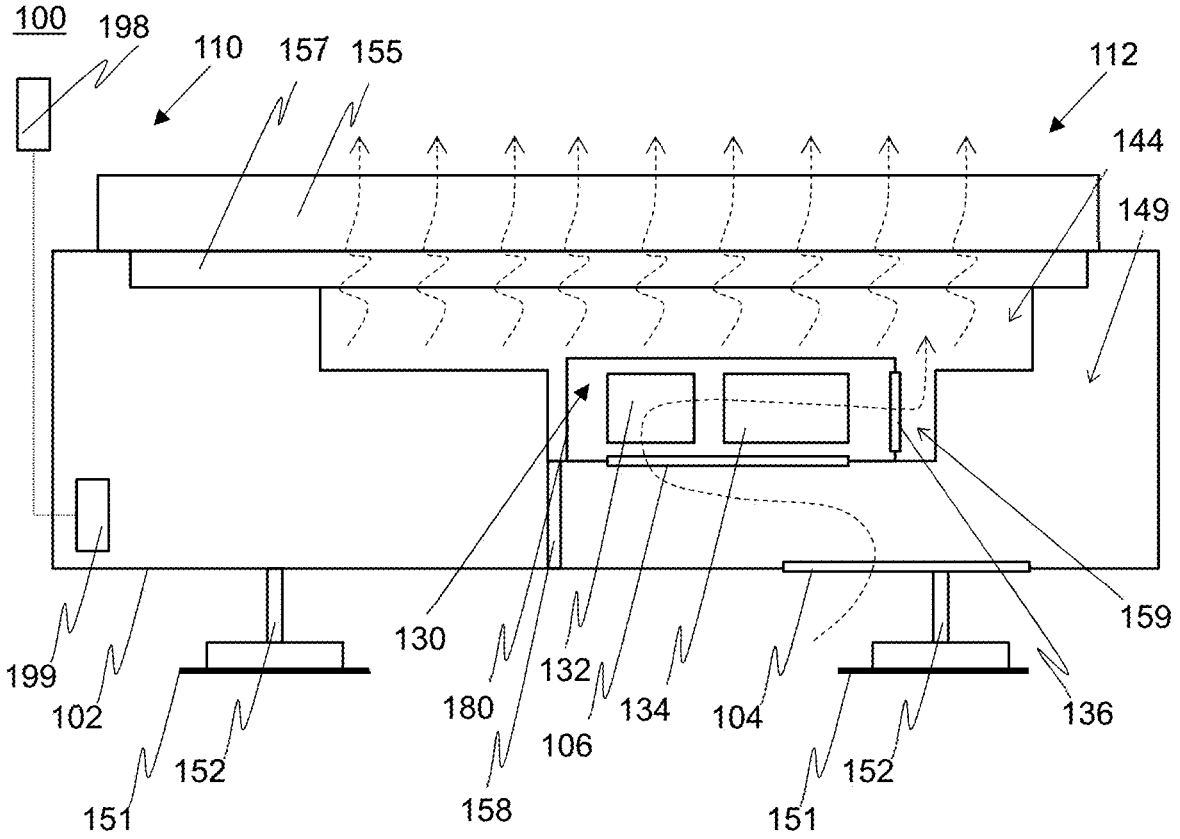
FIG. 1A shows an illustrative side view schematic of a bed, according to embodiments of the present technology, as a representative example of a piece of conditioned furniture.

FIG. 1A illustrates a side elevation schematic of a representative bed 100. In general, an example of air-flow through the bed 100 will be discussed in conjunction with the schematic illustration of the bed 100 of FIG. 1A. In FIG. 1A, air-flows are indicated with dashed lines ending in an arrow indicating the direction of the air-flow. FIG. 1A shows the bed in a schematic side view with different components inside a generally hollow shell frame 102.

Air may enter the bed 100 via one or more air inlets 104, which are generally provided in a bottom of the shell frame 102. When the shell frame 102 is placed on legs 152, the air inlet 104 (e.g., an outer air inlet) is exposed to air surrounding the bed. The shell frame 102 may be directly supported by the legs 152 standing on a floor 151, for example a bedroom floor, or may be supported via a further structural component such as the optional support frame.

Air-flow may be generated by a fan or other suitable air-flow generator. The fan 132 may form part of an air distribution unit 130. The air distribution unit 130 may comprise one or more air filters, such as an activated carbon filter for filtering contaminants from an air-flow by adsorption, and an optional heating unit 134. The one or more filters and optional heating unit 134 may be positioned upstream and/or downstream of the fan 132.

The air distribution unit 130 may comprise a fan enclosure 180 with a fan enclosure inlet that is aligned with an another air inlet 106 (e.g., an inner air inlet) of the shell frame 102, or is at least in fluid connection with the inner air inlet 106 of the shell frame 102. The fan enclosure 180 may further comprise a fan enclosure outlet 136 in fluid connection with a plenum chamber 144. Air may thus flow from the outer air inlet 104 to the air outlet 136, via the air distribution unit 130 to the plenum chamber 144.

An optional separator 158 is positioned inside the shell frame 102, forming an inlet chamber 149. In particular, the inlet chamber 149 may be positioned at a foot end 112 side of the bed 100. The separator 158 may prevent or reduce sound from being transported towards the head end 110 of the bed 100, where typically the ears of the person sleeping in the bed are positioned.

By virtue of the fan 132, a positive air pressure may be generated in the plenum chamber 144 with a pressure higher than ambient pressure, and a negative air pressure may be generated in the inlet chamber 149, which is lower than ambient pressure.

At least part of an inner surface of the inlet chamber 149 may be clad with sound absorbing material. Furthermore at least part of an inner surface of the plenum chamber 144 may (optionally) be clad with sound absorbing material.

As depicted in FIG. 1A, and applicable to other embodiments of the bed 100, the fan enclosure outlet 136 may be generally perpendicular to the inner air inlet 106 of the shell frame 102. The inner air inlet 106 of the shell frame 102 may be displaced vertically from the outer air inlet 104 of the shell frame 102 by a relatively short distance, which may result in a compact bed 100 in the vertical direction.

When the pressure inside the plenum chamber 144 exceeds ambient pressure, air flows through an optional slatted bed base 157 and through an air-permeable mattress 155. As such, air may flow past a person lying on the mattress 155.

As an option, the bed 100 may be arranged such that air-flow is only allowed through part of the mattress 155. In particular, air-flow may be prevented from flowing through a part of the mattress 155 at or near the head end 110 of the bed 100. This may prevent air-flow from leaking away, while air-flow further away from the head end 110, more near the foot end 112, may be at least partially trapped under a blanket which typically only covers the body of a person lying on the bed 100, and not the person's head.

In the example of FIG. 1A, when viewed from above, the plenum chamber 144 is smaller than the mattress 155. In particular, the plenum chamber 144 does not overlap with the mattress 155 at the head end 110.

Furniture, such as a bed 100, may be provided with a control unit 199, which may be arranged to control different components of the furniture for example based on data determined by one or more sensors forming or included in a sensor module 198. When the furniture comprises an air distribution unit, the control unit 199 may control the air distribution unit. For example, when the air distribution unit comprises a fan 132, the control unit 199 may be arranged to control the fan 132, thus controlling an air-flow through the furniture. When the air distribution unit comprises a heating unit 134, the control unit 199 may be arranged to control the heating unit 134 to increase the temperature of the air flowing through the furniture.

One or more sensors of the sensor module 198 may be included as part of the furniture and/or provided separately from the furniture. For example, one or more of the sensors may be positioned inside and/or on the furniture, and/or inside a room in which the furniture 100 is placed.

The sensor module 198 may be arranged for determining at least one of a temperature, humidity, air quality, flow rate, gas composition, particle density and/or any other suitable parameter relevant to the operation of the furniture. The sensor module 198 may be arranged to provided data to the control unit 199, which may be arranged to receive the data and control the furniture based on the data.

The sensor module 198 may comprise a presence sensor module for detecting the presence of a person on the furniture and/or in a room in which the furniture is present, and for generating a presence sensor signal indicative of the detected presence.

The presence sensor module may thus also be arranged to detect the presence of one or more persons on the furniture, for example on the mattress 155, and/or in the room in which the furniture is present. At least partially based on the detected presence, the control unit 199 may control the air-flow through the mattress 155. Since a higher air-flow may typically result in more noise, the control unit 199 may be arranged to reduce the air-flow when one or more persons are present on the mattress 155, and increase the air-flow when no persons are detected to control the temperature and/or humidity of the furniture, in particular the mattress 155, to a desired value or within a desired range.

As shown in FIG. 1A, the shell frame 102 may comprise one or more recessed sections, which in use are recessed towards a bottom of the bed. In particular, a recessed chamber 159 is available for removably accommodating at least part of the air distribution unit 130. The recessed chamber 159 may be open at the top, allowing the air distribution unit 130 to be placed in the recessed chamber 159 via this opened top.

As can be seen from FIG. 1A, the air distribution unit 130 is accessible from the top of the bed 100 by removing the mattress 155 and the bed base 157. As such, maintenance or replacement of the air distribution unit 130 may be easier. In particular, directly above the air distribution unit 130 up to the bed base 157, no other components of the bed 100 may be present, or any component that is present may be removable.

By being able to access the air distribution unit 130 via the plenum chamber 144, no other hatch or opening has to be present in the bed frame 102 for accessing the air distribution unit 130 for maintenance or replacement. This may increase aesthetics of the bed frame 102, and/or simplify construction of the bed frame 102.

Figure 1B:
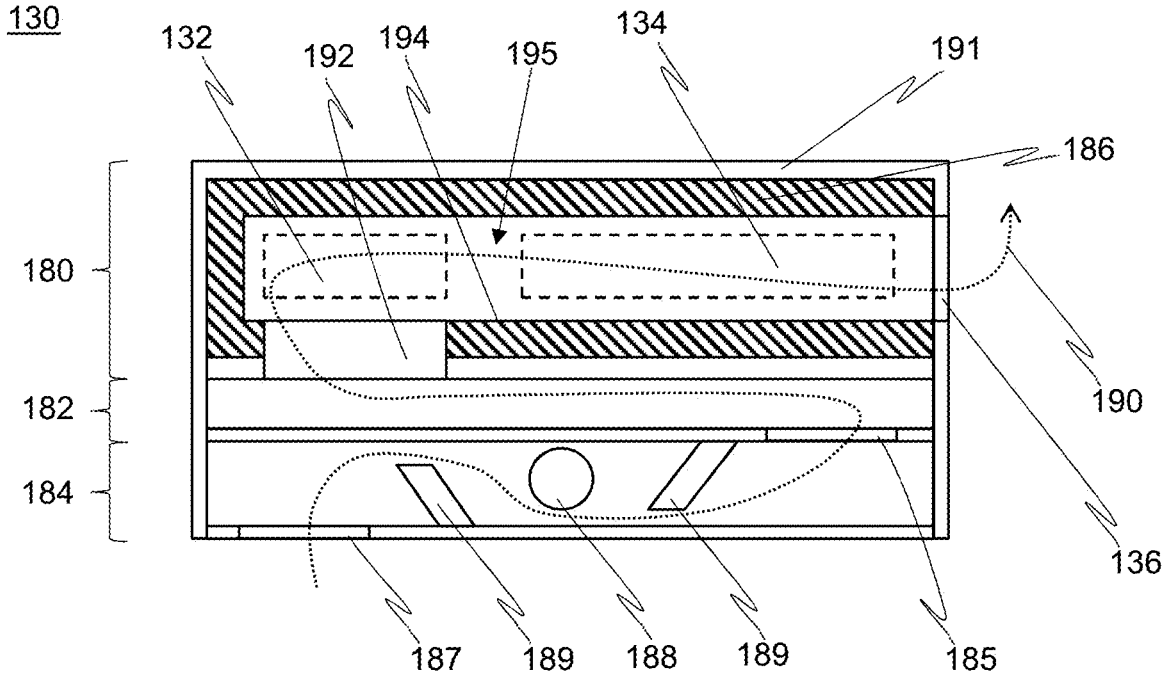
FIG. 1B is an illustrative sectioned schematic of an air distribution unit, according to embodiments of the present technology.

FIG. 1B schematically depicts an embodiment of an air distribution unit 130, comprising a fan enclosure 180, an optional air filter 182, and a further optional UV treatment module 184. A dotted line 190 indicates a typical air-flow through the air distribution unit 130, with the arrow indicating a typical air-flow direction.

The fan enclosure 180 is arranged for accommodating a fan 132. As an option, the fan enclosure 180 is further arranged for accommodating a heating unit 134. The heating unit 134 may be positioned upstream or downstream of the fan 132. In the particular embodiment of FIG. 1B, the heating unit 134 is positioned downstream of the fan 132.

The fan enclosure 180 comprises a fan enclosure inlet 192 upstream of the fan 132, and a fan enclosure outlet 136 downstream of the fan. An air-flow guidance member 186 is positioned in the fan enclosure 180, and is shown hatched in FIG. 1B. The air-flow guidance member 186 defines an air-flow path between the fan enclosure inlet 192 and the fan enclosure outlet 136. Between the fan enclosure inlet 192 and the fan enclosure outlet 136, an air-flow passing along the air-flow path may encounter both the fan 132 and the optional heating unit 134.

An inner surface 194 of the air-flow guidance member 186, adjacent to which the air-flow path is located, is at least partially sound-absorbing. This inner surface 194 may be at least partially sound-absorbing by virtue of the air-flow guidance member 186 comprising or consisting of sound-absorbing material.

The air-flow guidance member 186 may define an air-flow cavity 195 therein, through which cavity 195 the fan enclosure inlet 192 is in fluid connection with the fan enclosure outlet 136. As a particular option, generally the entire inner surface of the cavity 195 may be sound-absorbing.

When the fan 132 is placed in the fan enclosure 180 with the air-flow guidance member 186 (of which at least part of an inner surface 194 is sound-absorbing), sound generated by the fan 132 and/or air flowing through the fan enclosure 180 may be at least partially absorbed. As such sound generated by the fan 132 and/or air flowing through the fan enclosure 180 can exit the fan enclosure 180 may be prevented from exiting the enclosure.

Embodiments of an air distribution unit 130 may comprise an optional air filter 182, arranged to filter particles from the air-flow 190. The air filter 182 may be positioned upstream or downstream of the fan enclosure 180. For example, the air filter 182 may comprise one or more high-efficiency particulate air (HEPA) filters.

Embodiments of an air distribution unit 130 may comprise an optional UV treatment module 184 comprising a radiation source 188 for emitting UV-radiation, for example with a wavelength between 100-280 nm, also known as UV-C, and more particularly, a wavelength between 100 nm and 180 nm, or a wavelength of 254 nm. Such UV-radiation may kill, disable, or damage living organisms such as fungi, bacteria and/or viruses present in an air-flow.

Alternatively or additionally, a radiation source for emitting UV radiation in other spectra may be used. For example, radiation in the UV-A spectrum may be used, which is generally in a spectrum between 315-400 nm. As another example, radiation in the UV-B spectrum may be used, which is generally in a spectrum between 280-315 nm. It will be appreciated that multiple radiation sources may be used, each of which emits radiation in different wavelength range, and may be arranged in any suitable combination.

The UV treatment module 184 may be positioned downstream or upstream of the optional air filter 182, and may be positioned downstream or upstream of the fan enclosure 180.

One or more radiation barriers 189 may be positioned as baffles in the UV treatment module 184 to restrict radiation emitted by the radiation source 188 from leaving the UV treatment module 184, for example through a UV treatment air inlet 187 or a UV treatment air outlet 185. An extended flow path for air is provided between the UV treatment air inlet 187 and UV treatment air outlet 185, forming part of the air-flow 190 depicted in FIG. 1B.

The air-flow guidance member 186 may be a single or monolithic piece, or may comprise a plurality of members which together form the air-flow guidance member 186.

As an option, the air distribution unit 130 can include an outer housing 191, which for example may be generally stiff and formed, for example, from metal and/or plastic. The outer housing 191 may surround at least part of the fan enclosure 180, and can protect the fan enclosure 180 and/or provide stiffness to the fan enclosure 180.

Figure 2A:
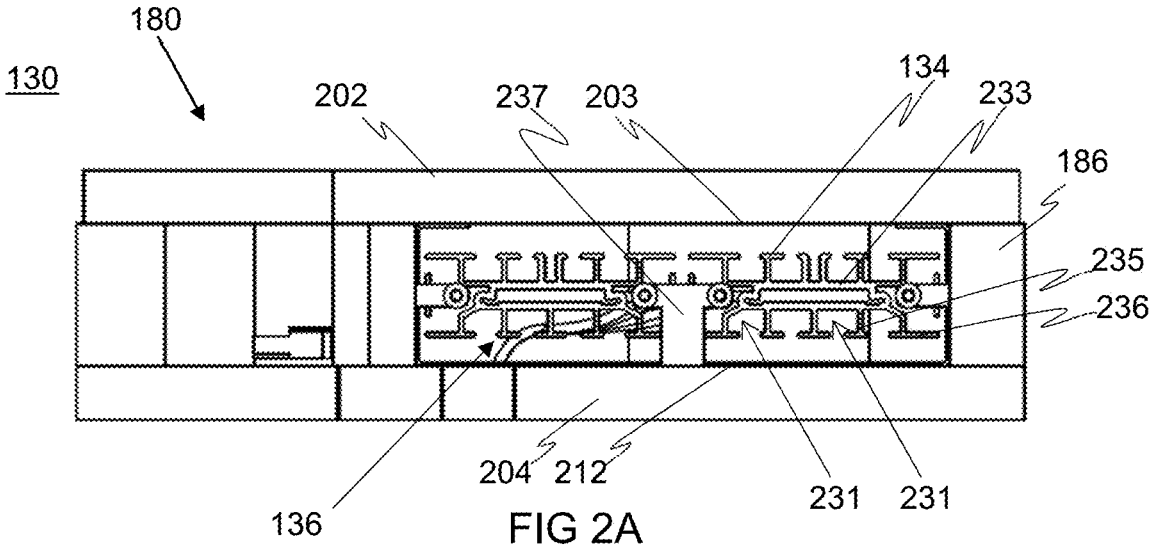
FIG. 2A is an end elevation view of the air distribution unit, showing details of a heating unit and an outlet, according to embodiments of the present technology.

FIG. 2A shows an embodiment of an air distribution unit 130 in a view looking into the fan enclosure outlet 136. In this particular embodiment, the fan enclosure 180 comprises an air-flow guidance member 186 sandwiched between an optional top guidance member 202 and a further optional bottom guidance member 204.

The flow of air through the fan enclosure 180 of FIG. 2A is constrained by the air-flow guidance member 186, an inner surface 203 of the top guidance member 202, and an inner surface 212 of the bottom guidance member 202.

In FIG. 2A, the heating unit 134 is depicted as comprising a plurality of channels 231, which may be oriented generally parallel to a part of the air-flow path through the air distribution unit 130 passing past and/or through the heating unit 134. For clarity of the figure, only two channels 231 are provided with a reference number. Representative heating units 134 may comprise any suitable number of channels, including only one channel.

The heating unit 134 of FIG. 2A comprises a base 233, and a channel 231 formed by a plurality of fins 235 extending from the base 233. To further increase the surface area of the heating unit 134, one or more end flanges 236 may extend from distal ends of one or more fins 235.

In the particular embodiment of FIG. 2A, the fins 235 extend generally perpendicular to the base 233, and the optional end flanges 236 are oriented generally parallel to the base 233, forming channels 231 with a generally rectangular cross-section.

The heating unit 134 may be coupled to the fan enclosure 180 with a mounting bracket 237. By virtue of the mounting bracket 237, the heating unit 134 may be positioned at a distance from the fan enclosure 180 to prevent direct contact between the heating unit 134 and the fan enclosure 180.

Figure 2B:
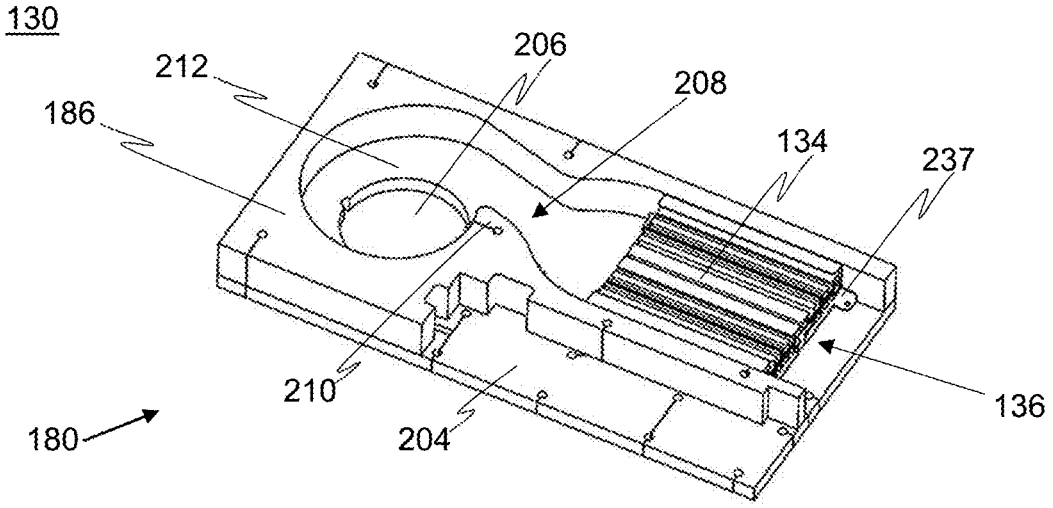
FIG. 2B is a perspective view of a lower half of a housing of the air distribution unit, revealing internal structural details, according to embodiments of the present technology; and, FIG. 2C is a perspective view of an air-flow guidance member, according to embodiments of the present technology.

FIG. 2B shows part of an air distribution unit 130, in particular the air-flow guidance member 186 and the bottom guidance member 204. The optional top guidance member 202 is not shown in this figure for purposes of clarity. The heating unit 134 is positioned in the air-flow guidance member 186, adjacent to the bottom guidance member 204.

For purposes of clarity, in FIG. 2B, the fan 132 (FIG. 1B) is omitted. The fan 132 may be aligned with an inlet opening 206 through the bottom guidance member 204. Downstream of the fan 132, a restriction 208 may be provided by virtue of a restricted section 210 of the air-flow guidance member 186. The heating unit 134 may be positioned downstream of the restriction 208. A rotation axis of the fan 132 may be generally perpendicular to the inlet opening 206.

As an option, the bottom guidance member 204 can be a monolithic piece consisting of a sound-absorbing material. As another option, at least part of a top surface 212 of the bottom guidance member 204 is sound-absorbing. This top surface 212 is adjacent to the air-flow path defined by the air-flow guidance member 186.

FIG. 2B shows at the bottom right, next to the heating unit 134, an open space in the air-flow guidance member 186, separated from the air-flow path. This open space is provided as a control unit sub-volume within an outer housing 191 (FIG. 1B) of the fan enclosure 180 (FIG. 1B). In the control unit sub-volume, a control unit comprising control electronics may be provided. As a result, in the embodiment shown in FIG. 2B, the outer housing 191 of the fan enclosure 180 is, apart from the air-flow path and the control unit sub-volume, generally filled or occupied by the air-flow guidance member 186. In this way, the air-flow guidance member 186 provides a curved air-flow path in the substantially cuboid or at least prismatic outer housing 191 of the fan enclosure 180. In representative embodiments, more than 80%, more than 85%, more than 90%, more than 95% or more than 99%, or 100% of the fan enclosure 180 other than the air-flow path and the control unit sub-volume is filled with a sound-absorbing substance.

Figure 2C:
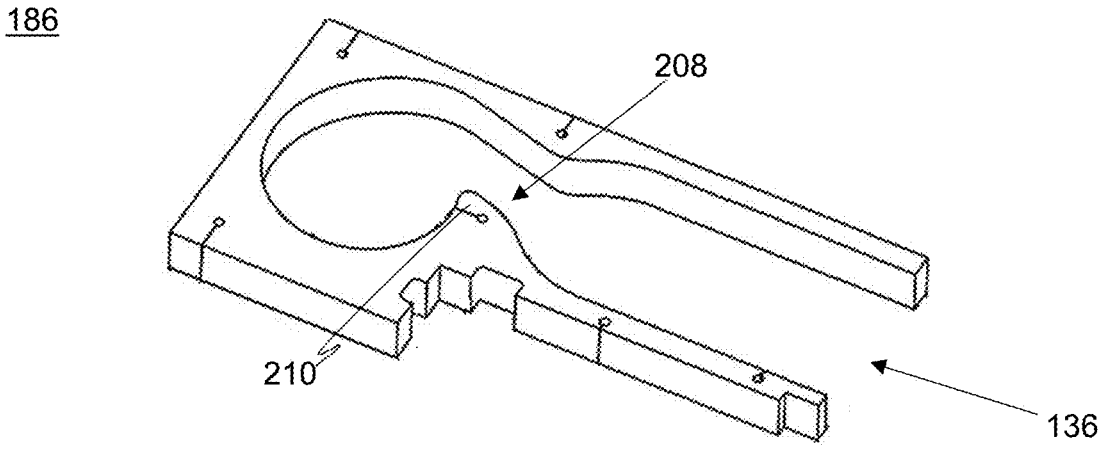

FIG. 2C shows an embodiment of an air-flow guidance member 186. The air-flow guidance member 186 may be a single monolithic part. As another option, the air-flow guidance member 186 can consist of sound-absorbing material, such as a foam, in particular an open-cell foam. The air-flow guidance member may be generally U-shaped.

It will be appreciated that depending on the orientation of the air distribution unit in use, a top guidance member may become a bottom guidance member and a bottom guidance member may become a top guidance member.

In the description above, it will be understood that when an element such as layer, region or substrate is referred to as being "on" or "onto" another element, the element is either directly on the other element, or intervening elements may also be present. Also, it will be understood that the values given in the description above, are given by way of example and that other values may be possible and/or may be strived for.

Furthermore, the present technology may also be embodied with less components than provided in the embodiments described here, wherein one component carries out multiple functions. Just as well may the present technology be embodied using more elements than depicted in the Figures, wherein functions carried out by one component in the embodiment provided are distributed over multiple components.

It is to be noted that the figures are only schematic representations of embodiments of the present technology that are given by way of non-limiting examples. For the purpose of clarity and a concise description, features are described herein as part of the same or separate embodiments, however, it will be appreciated that the scope of the present technology may include embodiments having combinations of all or some of the features described.

The word 'comprising' does not exclude the presence of other features or steps than those listed in a claim. Furthermore, the words 'a' and 'an' shall not be construed as limited to 'only one', but instead are used to mean 'at least one', and do not exclude a plurality. As used herein, the term "and/or," as in "A and/or B" refers to A alone, B alone and both A and B. As used herein, the terms "about" and "approximately" refer to values within 10% of the stated value.

A person skilled in the art will readily appreciate that various parameters and values thereof disclosed in the description may be modified and that various embodiments disclosed and/or claimed may be combined without departing from the scope of the present technology.

The following examples provide addition embodiments of the present technology:

1. An air distribution unit for environmentally controlled furniture, comprising:
   - a fan enclosure having a fan position configured to accommodate a fan, the fan enclosure having a fan enclosure inlet upstream of the fan position and a fan enclosure outlet downstream of the fan position, the fan enclosure further including:
     - an air-flow guidance member positioned in the fan enclosure, and defining, at least in part, an air-flow path between the fan enclosure inlet and the fan enclosure outlet, wherein an inner surface of the air-flow guidance member, adjacent to the air-flow path, is at least partially sound-absorbing.

2. The air distribution unit of example 1, wherein the fan enclosure further comprises a top guidance member positioned adjacent to the air-flow guidance member, wherein at least part of the top guidance member is sound-absorbing and adjacent to the air-flow path.

3. The air distribution unit of example 1 or 2, wherein the fan enclosure further comprises a bottom guidance member positioned adjacent to the air-flow guidance member, wherein at least part of the bottom guidance member is sound-absorbing and adjacent to the air-flow path.

4. The air distribution unit of example 3, to the extent dependent on example 2, wherein the air-flow guidance member is sandwiched between the top guidance member and the bottom guidance member.

5. The air distribution unit of any preceding example, wherein the air-flow guidance member consists of sound-absorbing material.

6. The air distribution unit of example 5, wherein the fan enclosure has a generally prismatic shape and the air-flow path has an at least partially curved shaped defined by the air-flow guidance member.

7. The air distribution unit of any preceding example, wherein the fan enclosure further comprises a control unit provided in a control unit sub-volume and at least 80% of a volume of the fan enclosure, other than the air-flow path and the control unit sub-volume, is filled with a sound-absorbing material.

8. The air distribution unit of any preceding example, wherein the sound-absorbing material includes an open cell foam.

9. The air distribution unit of any preceding example, further comprising a heating unit configured to heat an air-flow passing along the air-flow path, the heating unit comprising a heat generator and a plurality of channels oriented generally parallel to the air-flow path, wherein walls of the channels are coupled to the heat generator.

10. The air distribution unit of example 9, wherein the heating unit comprises a base, the heat generator is provided in the base, and the plurality of channels is formed by a plurality of fins extending from the base.

11. The air distribution unit of example 10, wherein at least one of the fins includes an end flange at a distal end of the fin, the end flange protruding from the fin at an angle relative to the fin.

12. The air distribution unit of any of examples 9-11, wherein a ratio of the length divided by the width of the channels is 5 or more.

13. The air distribution unit of any preceding example, further comprising a UV treatment module having a radiation source configured to emit UV-radiation with a wavelength between 100-280 nm, wherein the UV treatment module is positioned between a UV treatment inlet and a UV treatment outlet of the UV treatment module, in fluid communication with the air-flow path.

14. The air distribution unit of example 13, wherein the radiation source extends over at least 50% of a width of the air-flow path.

15. The air distribution unit of example 13 or 14, wherein the UV treatment module includes an upstream baffle upstream of the radiation source and a downstream baffle downstream of the radiation source.

16. The air distribution unit of example 15, wherein the upstream baffle is positioned such that no direct path exists between the radiation source and the UV treatment inlet and the downstream baffle is positioned such that no direct path exists between the radiation source and the UV treatment outlet.

17. The air distribution unit of example 15, wherein the UV treatment module includes a housing having a first wall and a second wall opposite to the second wall, wherein the UV treatment inlet and the upstream baffle are provided on the first wall and the UV treatment outlet and the downstream baffle are provided on the second wall.

18. The air distribution unit of example 17, wherein the upstream baffle is positioned at an angle tilted towards the UV treatment inlet and the downstream baffle is positioned at an angle tilted towards the UV treatment outlet.

19. The air distribution unit of any preceding example, further comprising an outer housing positioned around at least part of the fan enclosure.

20. An environmentally conditioned bed, comprising:

a bed frame supporting an air-permeable mattress, the bed frame comprising:

an air inlet with an inlet flow-through area;

an air outlet with an outlet flow-through area, which air outlet is in fluid connection with the air inlet;

the air distribution unit of claim 1, wherein the fan enclosure inlet is in fluid communication with the air outlet and the fan enclosure outlet is in fluid communication with the air-permeable mattress.

21. The bed of example 20, further comprising:

a presence sensor module configured to detect a presence of a person on the bed, and/or in a room in which the bed is present, the presence sensor being configured to generate a presence sensor signal indicative of the detected presence; and a control unit coupled to the presence sensor module to control the air distribution unit based at least in part on the presence sensor signal.

22. A method for operating an air distribution unit of a piece of environmentally controllable furniture, for example, the bed of example 21, the method comprising:

using a presence sensor module, detecting a presence of a person on the furniture and/or in a room in which the furniture is present;

when the presence is detected, operating the air distribution unit in a first operating mode; and when no presence is detected, operating the air distribution unit in a second operating mode.

23. The method of example 22, wherein the air distribution unit comprises a fan for generating an air-flow with a first maximum air-flow speed in the first operating mode, and a second maximum air-flow speed, lower than the first maximum air-flow speed, in the second operating mode.

We claim:

1. An air distribution unit for environmentally controlled furniture, comprising:

a fan enclosure having a fan position configured to accommodate a fan, the fan enclosure having a fan enclosure inlet upstream of the fan position and a fan enclosure outlet downstream of the fan position, the fan enclosure further including:

an air-flow guidance member positioned in the fan enclosure, defining, at least in part, an air-flow path between the fan enclosure inlet and the fan enclosure outlet, and extending beyond the fan, wherein an inner surface of the air-flow guidance member, adjacent to and defining opposing walls of the air-flow path, is at least partially sound-absorbing.

2. The air distribution unit of claim 1, wherein the fan enclosure further comprises a top guidance member positioned adjacent to the air-flow guidance member, wherein at least part of the top guidance member is sound-absorbing and adjacent to the air-flow path.

3. The air distribution unit of claim 2, wherein the fan enclosure further comprises a bottom guidance member positioned adjacent to the air-flow guidance member, wherein at least part of the bottom guidance member is sound-absorbing and adjacent to the air-flow path.

4. The air distribution unit of claim 3, wherein the air-flow guidance member is sandwiched between the top guidance member and the bottom guidance member.

5. The air distribution unit of claim 1, wherein the air-flow guidance member comprises sound-absorbing material.

6. The air distribution unit of claim 5, wherein the fan enclosure has a generally prismatic shape and the air-flow path has an at least partially curved shaped defined by the air-flow guidance member.

7. The air distribution unit of claim 1, wherein the fan enclosure further comprises a control unit provided in a control unit sub-volume and at least 80% of a volume of the fan enclosure, other than the air-flow path and the control unit sub-volume, is filled with a sound-absorbing material.

8. The air distribution unit of claim 7, wherein the sound-absorbing material includes an open cell foam.

9. The air distribution unit of claim 1, further comprising a heating unit configured to heat an air-flow passing along the air-flow path, the heating unit comprising a heat generator and a plurality of channels oriented generally parallel to the air-flow path, wherein walls of the channels are coupled to the heat generator.

10. The air distribution unit of claim 9, wherein the heating unit comprises a base, the heat generator is provided in the base, and the plurality of channels is formed by a plurality of fins extending from the base.

11. The air distribution unit of claim 10, wherein at least one of the fins includes an end flange at a distal end of the fin, the end flange protruding from the fin at an angle relative to the fin.

12. The air distribution unit of claim 11, wherein a ratio of a length divided by a width of the individual channels is 5 or more.

13. The air distribution unit of claim 1, further comprising a UV treatment module having a radiation source configured to emit UV-radiation with a wavelength between 100-280 nm, wherein the UV treatment module is positioned between a UV treatment inlet and a UV treatment outlet of the UV treatment module, in fluid communication with the air-flow path.

14. The air distribution unit of claim 13, wherein the radiation source extends over at least 50% of a width of the air-flow path.

15. The air distribution unit of claim 13, wherein the UV treatment module includes an upstream baffle upstream of the radiation source and a downstream baffle downstream of the radiation source.

16. The air distribution unit of claim 15, wherein the upstream baffle is positioned such that no direct path exists between the radiation source and the UV treatment inlet and the downstream baffle is positioned such that no direct path exists between the radiation source and the UV treatment outlet.

17. The air distribution unit of claim 15, wherein the UV treatment module includes a housing having a first wall and a second wall opposite to the first wall, wherein the UV treatment inlet and the upstream baffle are provided on the first wall and the UV treatment outlet and the downstream baffle are provided on the second wall.

18. The air distribution unit of claim 17, wherein the upstream baffle is positioned at an angle tilted towards the UV treatment inlet and the downstream baffle is positioned at an angle tilted towards the UV treatment outlet.

19. The air distribution unit of claim 1, further comprising an outer housing positioned around at least part of the fan enclosure.

20. An environmentally conditioned bed, comprising:

a bed frame supporting an air-permeable mattress, the bed frame comprising:

an air inlet with an inlet flow-through area;

an air outlet with an outlet flow-through area, which air outlet is in fluid connection with the air inlet;

the air distribution unit of claim 1, wherein the fan enclosure inlet is in fluid communication with the air outlet and the fan enclosure outlet is in fluid communication with the air-permeable mattress.

21. The bed of claim 20, further comprising:

a presence sensor module configured to detect a presence of a person on the bed, and/or in a room in which the bed is present, the presence sensor being configured to generate a presence sensor signal indicative of the detected presence; and a control unit coupled to the presence sensor module to control the air distribution unit based at least in part on the presence sensor signal.

22. The air distribution unit of claim 1, further comprising:

an outer housing positioned around at least part of the fan enclosure, an outer surface of the air-flow guidance member being in conformal contact with a surface of the outer housing along the air-flow path.

23. A method for operating an air distribution unit of an environmentally controllable furniture piece, the method comprising:

using a presence sensor module, detecting a presence of a person on the furniture and/or in a room in which the furniture is present;

when the presence is detected, operating the air distribution unit in a first operating mode; and when no presence is detected, operating the air distribution unit in a second operating mode, wherein the air distribution unit comprises:

a fan enclosure having a fan position configured to accommodate a fan, the fan enclosure having a fan enclosure inlet upstream of the fan position and a fan enclosure outlet downstream of the fan position, the fan enclosure further including:

an air-flow guidance member positioned in the fan enclosure, defining, at least in part, an air-flow path between the fan enclosure inlet and the fan enclosure outlet, and extending beyond the fan, wherein an inner surface of the air-flow guidance member, adjacent to and defining opposing walls of the air-flow path, is at least partially sound-absorbing.

24. The method of claim 23, wherein the fan of the air distribution unit is configured to generate an air-flow with a first maximum air-flow speed in the first operating mode, and a second maximum air-flow speed, lower than the first maximum air-flow speed, in the second operating mode.

25. The method of claim 23, wherein the air distribution unit further comprises:

an outer housing positioned around at least part of the fan enclosure, an outer surface of the air-flow guidance member being in conformal contact with a surface of the outer housing along the air-flow path.

26. An air distribution unit for environmentally controlled furniture, comprising:

a fan enclosure having a fan position configured to accommodate a fan, the fan enclosure having a fan enclosure inlet upstream of the fan position and a fan enclosure outlet downstream of the fan position, the fan enclosure further including:

an air-flow guidance member positioned in the fan enclosure, and defining, at least in part, an air-flow path between the fan enclosure inlet and the fan enclosure outlet, wherein an inner surface of the air-flow guidance member, adjacent to and defining opposing walls of the air-flow path, is at least partially sound-absorbing, and a UV treatment module having a radiation source configured to emit UV-radiation, wherein:

the UV treatment module includes a housing having a first wall and a second wall opposite to the first wall, an upstream baffle that is upstream of the radiation source and fixedly attached to the first wall, and a downstream baffle that is downstream of the radiation source and fixedly attached to the second wall.

27. The air distribution unit of claim 26, further comprising:

an outer housing positioned around at least part of the fan enclosure, an outer surface of the air-flow guidance member being in conformal contact with a surface of the outer housing along the air-flow path.

* * * * *